US009473842B2

(12) United States Patent
Shin

(10) Patent No.: US 9,473,842 B2
(45) Date of Patent: Oct. 18, 2016

(54) EARSET

(71) Applicant: Haebora Co., Ltd., Seoul (KR)

(72) Inventor: Doo Sik Shin, Seoul (KR)

(73) Assignee: Haebora Co., Ltd., Seoul (KR)

( * ) Notice: Subject to any disclaimer, the term of this patent is extended or adjusted under 35 U.S.C. 154(b) by 0 days.

(21) Appl. No.: 14/837,157

(22) Filed: Aug. 27, 2015

(65) Prior Publication Data

US 2016/0073187 A1 Mar. 10, 2016

(30) Foreign Application Priority Data

Sep. 5, 2014 (KR) ..... 10-2014-0118585
Apr. 3, 2015 (KR) ..... 10-2015-0047305

(51) Int. Cl.
*H04R 25/00* (2006.01)
*H04R 1/10* (2006.01)
*H04R 3/00* (2006.01)

(52) U.S. Cl.
CPC ..... *H04R 1/1016* (2013.01); *H04R 3/00* (2013.01); *H04R 2201/107* (2013.01)

(58) Field of Classification Search
CPC . H04R 1/1016; H04R 2201/107; H04R 3/00
USPC ..... 381/380, 370, 151, 326, 328, 74
See application file for complete search history.

(56) References Cited

U.S. PATENT DOCUMENTS 6,574,345 B1 * 6/2003 Huang ..... H04R 1/1016 379/430
7,983,433 B2 * 7/2011 Nemirovski ..... H04R 1/1016 381/151
2008/0226090 A1 * 9/2008 Seto ..... H04R 3/02 381/66

FOREIGN PATENT DOCUMENTS

KR 1020130110332 A 10/2013

* cited by examiner

*Primary Examiner* — Sunita Joshi
(74) *Attorney, Agent, or Firm* — Hammer & Associates, P.C.

(57) ABSTRACT

Disclosed is an earset. The earset includes a case that forms an appearance thereof, an ear pad that is mounted in one end portion of the case and is attached to/detached from a user's ear, and a soundproof housing that is accommodated in the case and in which a speaker and a microphone are arranged in a forward/backward direction along an axial line of the ear pad.

5 Claims, 9 Drawing Sheets

EARSET

CROSS-REFERENCE TO RELATED APPLICATION

This application claims priority to and the benefit of Korean Patent Application No. 2015-0047305, filed on Apr. 3, 2015, the disclosure of which is incorporated herein by reference in its entirety.

BACKGROUND

1. Field of the Invention

The present invention relates to an earset, and more particularly, to an earset that improves an accommodating structure of a speaker and a microphone in an earset in which the speaker and the microphone are integrated.

2. Discussion of Related Art

In general, an earset is a voice transmission and reception device in which an earphone (speaker) and a microphone (mike) are combined, and is connected to an electronic device such as an MP3 player, a mobile phone, or the like in a wired or wireless manner, so that sounds such as sound, voice, and the like are transmitted and received via a user's ear and mouth.

Such an earset is roughly classified into a separation type earset in which a speaker for transmitting sound is inserted into a user's ear and a microphone is arranged near a user's mouth, and an integration type earset in which the speaker and the microphone are both inserted into the user's ear.

In the case of the separation type earset, the speaker and the microphone are positioned to be separated from each other, so that there is convenience in that a user can listen to music or make a call while both hands are free. However, when the user is positioned in a noisy place or moves his or her body, the speaker inserted into the user's ear is removed from the user's ear or the position of the microphone is shaking, and therefore sound cannot be accurately transmitted.

Whereas, in the case of the integration type earset, an ear pad inserted into the external auditory meatus is mounted and the speaker and the microphone are both inserted into the user's ear, so that sound can be accurately transmitted even in the noisy place, compared to the separation type earset.

As the prior art of such an integration type earset, an earset which has been filed as a patent application (dated on Mar. 29, 2012) by the present applicant and publication-registered (dated on Dec. 12, 2013) is disclosed as Korean Patent Registration No. 10-1341308.

However, in such a conventional earset, there is a problem in that the structural limits are produced so as to increase the output of the speaker and improve the sound quality.

The output of the speaker is proportional to the size of the speaker, and therefore a speaker having as large size as possible may be used to improve the output of the speaker.

However, in the conventional earset, the speaker and the microphone are accommodated and arranged side by side in a vertical direction with respect to an axial line of the ear pad, and thereby there are restrictions in the arrangement of the large-sized speaker so as to increase the output of the speaker.

That is, when using the large-sized speaker so as to increase the output of the speaker, the region of the speaker overlaps with the region of the microphone, so that the sound output from the speaker is likely to overlap with the sound flowing into the microphone.

In order to increase the output of the speaker while avoiding the overlapping between the sound output from the speaker and the sound flowing into the microphone, a soundproof housing that accommodates the speaker and the microphone should be large, which leads to an increase in the overall size of the earset.

Therefore, there are demands for the development of an earset that can improve the output of the speaker regardless of the sizes of the speaker and the microphone.

PRIOR ART DOCUMENT

Patent Document 1

Korean Patent No. 10-1341308 (Title of the invention: Soundproof housing for earset and wired/wireless earset having the same, published on Dec. 12, 2013)

SUMMARY OF THE INVENTION

The present invention is directed to providing an earset in which a speaker and a microphone may be efficiently arranged regardless of the sizes of the speaker and the microphone so that an internal space may be efficiently used, and the output of the speaker may be increased while avoiding the overlapping between the sound output from the speaker and the sound flowing into the microphone.

The present invention is also directed to providing an earset which may improve the sound quality of the sound output from the speaker and improve the noise shielding performance of the microphone.

According to an aspect of the present invention, there is provided an earset including: a case that forms an appearance thereof; an ear pad that is mounted in one end portion of the case, and is attached to/detached from a user's ear; and a soundproof housing that is accommodated in the case, and in which a speaker and a microphone are arranged in a forward/backward direction along an axial line of the ear pad.

According to another aspect of the present invention, there is provided an earset including: a case that forms an appearance thereof; an ear pad that is mounted in one end portion of the case, forms a communication hole communicating with a user's external auditory meatus, and is attached to/detached from a user's ear; and a soundproof housing that is accommodated in the case and forms a speaker accommodating groove for accommodating a speaker and a microphone accommodating groove for accommodating a microphone. Here, the microphone accommodating groove may be formed toward the ear pad, and the speaker accommodating groove may be formed behind the microphone accommodating groove.

Also, the soundproof housing may include a speaker output hole that communicates with the speaker accommodating groove and the communication hole, and transmits sound generated from the speaker to the communication hole of the ear pad, and a microphone input hole that communicates with the microphone accommodating groove and the communication hole, and transmits, to the microphone, sound transmitted from the user's ear to the communication hole of the ear pad.

Also, the speaker output hole and the microphone input hole may be arranged to be independently separated from each other.

Also, in the soundproof housing, one or more tuning holes that communicate with at least any one of the input and the output of the speaker from the outside of the soundproof housing may be formed.

Also, in the soundproof housing, one or more back holes that allow sound transmitted from the user's ears to the communication hole of the ear pad to flow into a rear surface of the microphone may be formed.

BRIEF DESCRIPTION OF THE DRAWINGS

The above and other objects, features and advantages of the present invention will become more apparent to those of ordinary skill in the art by describing in detail exemplary embodiments thereof with reference to the accompanying drawings, in which.

DETAILED DESCRIPTION OF EXEMPLARY EMBODIMENTS

Figure 1:
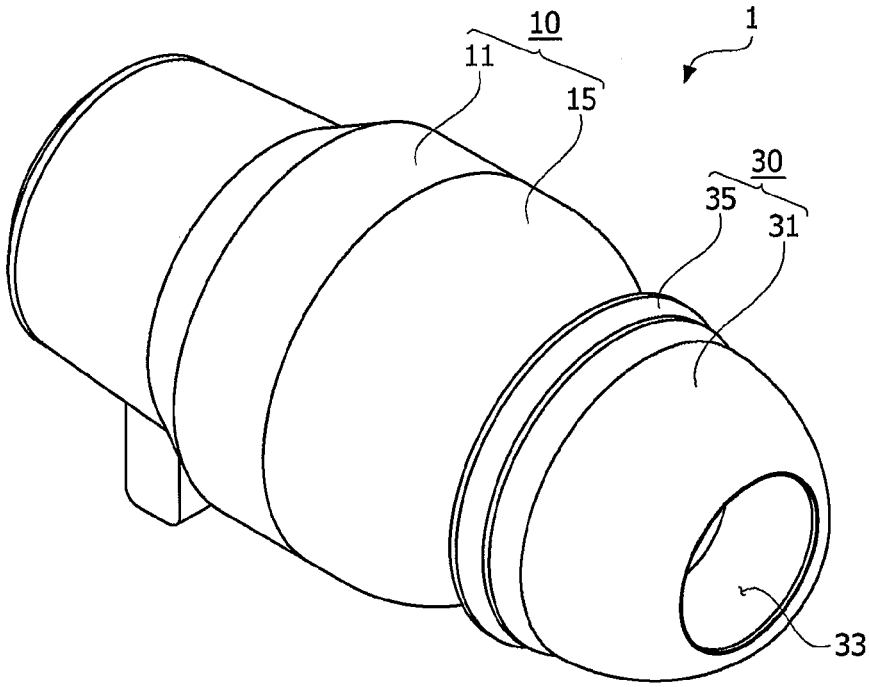
FIG. 1 is a perspective view showing an earset according to an embodiment of the present invention.

Hereinafter, embodiments of the present invention will be described in detail with reference to the accompanying drawings.

Prior to description, an earset in the following description is a device that is configured in such a manner that a speaker and a microphone are integrated and is inserted into a user's ear, and may be applied to an earphone for listening to music, a wired ear microphone, a Bluetooth headset, a Wi-Fi headset, an NFC (Near Field Communication) headset, a binary CDMA headset, and a voice search or voice control headset.

In FIGS. 1 to 8, an earset according to an embodiment of the present invention is shown. As shown in FIGS. 1 to 8, an earset 1 according to an embodiment of the present invention includes a case 10, an ear pad 30, and a soundproof housing 40.

The case 10 forms the overall appearance of the earset 1. The case 10 forms a receiving space for receiving the soundproof housing 40 therein, has a protrusion portion 19 to which the ear pad 30 is coupled, and includes a rear case 11 and a front case 15.

The rear case 11 is a portion that forms the appearance of the earset 1, and a cable may be connected to the rear case 11. Here, a connector (not shown) that can be connected to an external device may be coupled to the cable. Obviously, in a case of a wireless earset, the rear case 11 may be directly coupled to a Bluetooth main body in an electrical and mechanical manner.

The front case 15 is a portion that is inserted into a user's external auditory meatus, and is coupled to the rear case 11 to form the overall case 10.

The front case 15 includes a front case main body 17 that is detachably coupled to the rear case 11, and the protrusion portion 19 that protrudes from an end portion of the front case main body 17 by a predetermined length so that the protrusion portion 19 can be inserted into the user's ear. The inside of the front case main body 17 and the inside of the protrusion portion 19 communicate with each other. That is, the front case 15 and the protrusion portion 19 may be integrally formed to have a single large hole that is penetratingly formed.

Figure 2:
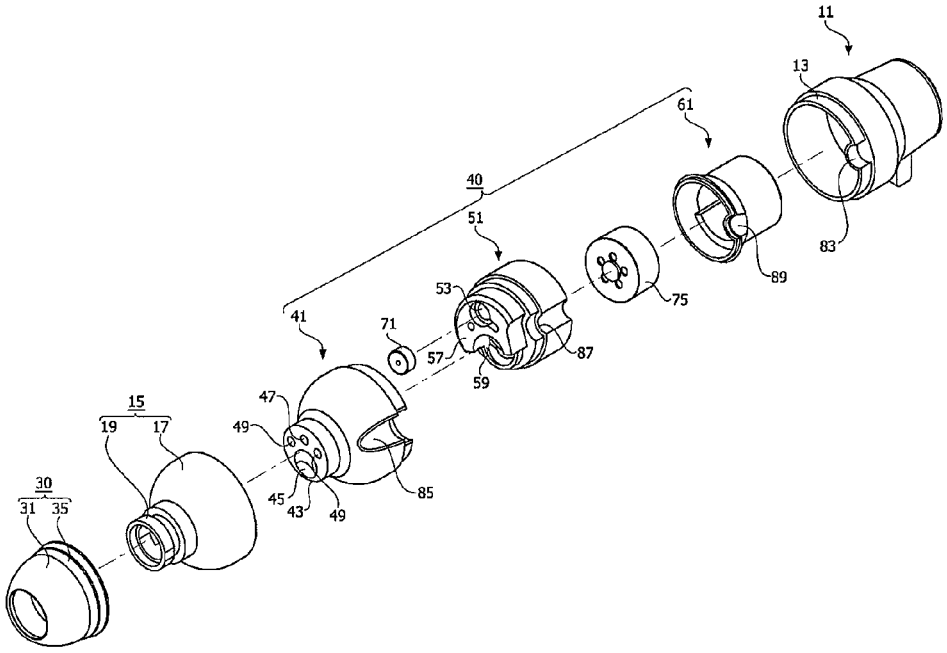
FIG. 2 is a front exploded perspective view of FIG. 1.

Meanwhile, the rear case 11 and the front case 15 may be forcibly fitted to each other while keeping the airtightness. According to an embodiment, as shown in FIG. 2, a fitting jaw 13 is protrusively formed in an outer peripheral portion of the end portion of the rear case 11 facing the front case 15, and a fitting groove 21 to which the fitting jaw 13 of the rear case 11 is forcibly fitted is formed in an inner peripheral portion of the end portion of the front case 15 facing the rear case 11.

The ear pad 30 is mounted in an end portion of the case 10, forms a communication hole 33 that communicates with the external auditory meatus, and is attached to/detached from the user's ear.

The ear pad 30 is coupled to the protrusion portion 19 of the front case 15, so that the front case 15 can be easily inserted into the user's ear. The ear pad 30 may be made of a material of any one of a silicone, a synthetic resin, and rubber which are elastically deformable, so that the ear pad 30 is brought into contact with the user's external auditory meatus in an expandable manner.

Such an ear pad 30 includes an ear pad body 31 and a plurality of treads 35.

The ear pad body 31 has a shape in which a distal end portion of the ear pad body 31 is partially cut, that is, a truncated semi-circular cross-sectional shape, so that the ear pad body 31 can be easily inserted into the user's external auditory meatus. The ear pad body 31 is coupled to the protrusion portion 19 of the front case 15, and the communication hole 33 that communicates with speaker output holes 45 and 59 and a microphone input hole 47 of the soundproof housing 40, which will be described below, is formed inside the ear pad body 31. The communication hole 33 serves to transmit the sound generated from the speaker 75 to the user's external auditory meatus, and transmit the sound generated from the user's mouth to the microphone 71 through the user's external auditory meatus. Here, the ear pad body 31 is illustrated to have the truncated semi-circular cross-sectional shape, but the present invention is not limited thereto. For example, the ear pad body 31 may have a truncated elliptical shape.

The plurality of treads 35 has a ring shape, and are formed at an interval on an outer peripheral surface of the opposite end portion of the distal end portion of the ear pad body 31. The plurality of treads 35 has an inclined portion 37 that is inclined downward in an insertion direction in which the ear pad 30 is inserted into the external auditory meatus with respect to an axial line of the communication hole 33 of the ear pad body 31. Thus, the treads 35 have a triangular cross-sectional shape as a whole. As a result, the ear pad 30 may be easily inserted into the external auditory meatus, and the movement of the ear pad 30 may be suppressed by friction between the treads 35 and an inner wall of the external auditory meatus, thereby providing the comfortable and stable wearing sensation.

Figure 9:
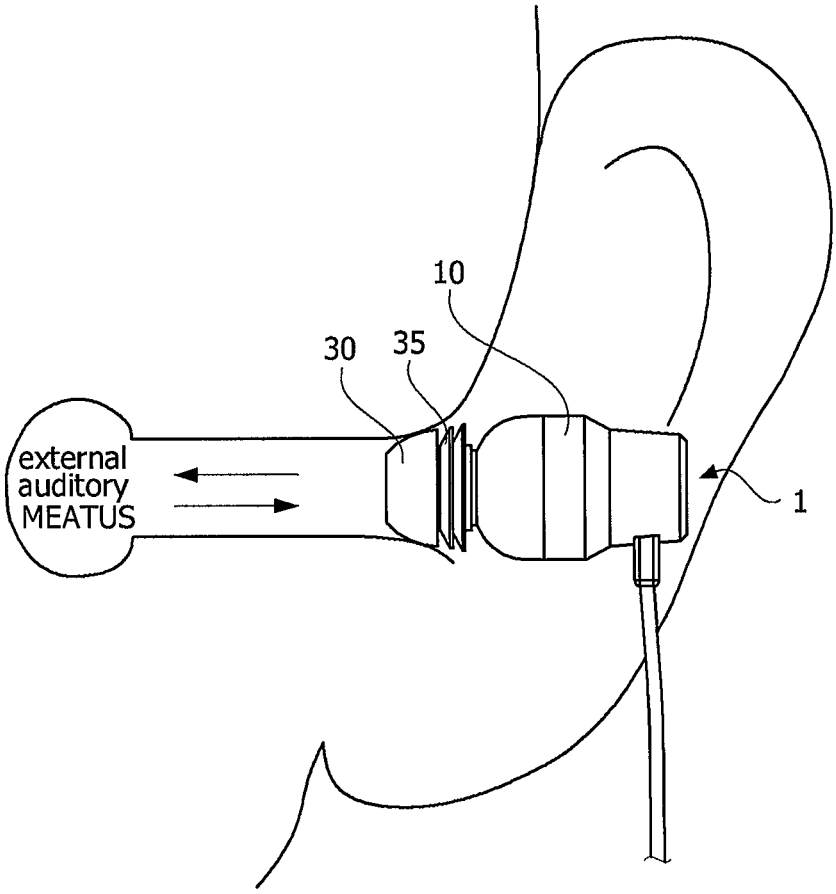
FIG. 9 is a cross-sectional view showing a state in which an earset according to an embodiment of the present invention is mounted.

In addition, the plurality of treads 35 have a cross-sectional shape in which the outer diameter is gradually increased toward the case 10. That is, the plurality of treads 35 have a cross-sectional shape in which the diameter is gradually increased in a direction opposite to the insertion direction into the external auditory meatus. Accordingly, as shown in FIG. 9, when the earset 1 according to an embodiment of the present invention is mounted in the external auditory meatus, adhesion between the treads 35 and the inner wall of the external auditory meatus is more enhanced, so that external noise may be shielded from flowing into the external auditory canal and the ear pad 30 may be wearable regardless of the size of the external auditory meatus, thereby the user's convenience is increased.

Here, the cross-sectional shape of the treads 35 may have a circular or polygonal cross-shape in addition to a triangular cross-sectional shape. The plurality of treads 35 may have the same outer diameter.

Meanwhile, the soundproof housing 40 is received in the case 10, so that the sound generated from the speaker 75 is transmitted to the ear pad 30 and the sound transmitted from the user's ear to the ear pad 30 is transmitted to the microphone 71. In addition, the soundproof housing 40 serves to block an echo phenomenon and a howling phenomenon which may occur due to the external noise flowing into the external auditory meatus through the front case 15 or the rear case 11, and serves to reduce the occurrence of vibration noise caused by the speaker 75 and the microphone 71 to improve the sound quality.

The soundproof housing 40 is received in an inner receiving space of the case 10 in the form that a first soundproof housing 41, a second soundproof housing 51, and a third soundproof housing 61 are combined. For example, the soundproof housing 40 is received in the inner receiving space of the rear case 11 and the front case 15.

The first soundproof housing 41 may be provided in one region of the inner receiving space of the front case 15 to protrude long toward the inside of the protrusion portion 19 of the front case 15. For example, in the first soundproof housing 41, an insertion protrusion portion 43 corresponding to the inner cross-sectional shape of the protrusion portion 19 of the front case 15 is formed.

In addition, in the first soundproof housing 41, a first speaker output hole 45 for outputting the sound generated from the speaker 75, a microphone input hole 47 for inputting the sound transmitted from the user's ear to the communication hole 33 of the ear pad 30 to the front surface of the microphone 71, and a pair of back holes 49 for inputting the sound transmitted from the user's ear to the communication hole 33 of the ear pad 30 to the rear surface of the microphone 71 are formed.

The pair of back holes 49 is provided to have the microphone input hole 47 interposed therebetween.

The first speaker output hole 45, the microphone input hole 47, and the back hole 49 communicate with the communication hole 33 of the ear pad 30, and are arranged to be independently separated from one another so as to prevent the sound from the speaker 75 from flowing into the microphone 71.

Here, according to the present embodiment, a case in which the pair of back holes 49 is provided is illustrated, but the present is not limited thereto. One or more back holes 49 may be provided.

Figure 3:
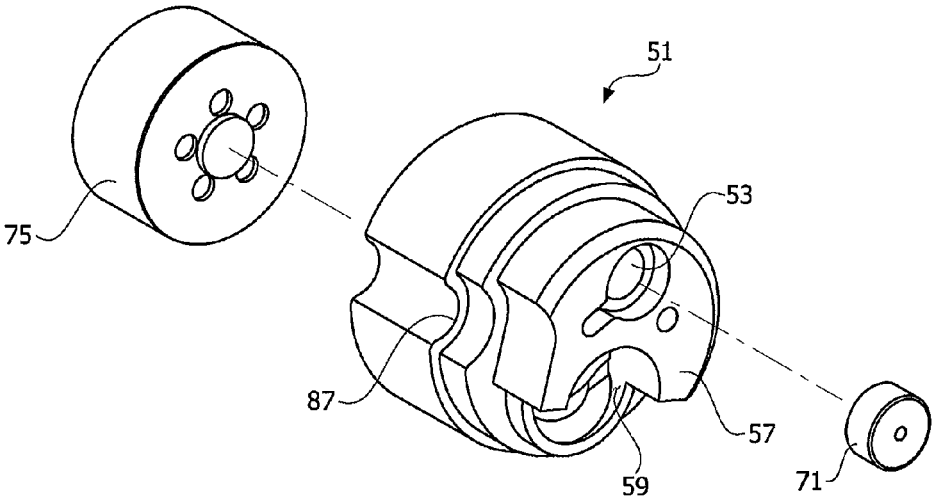
FIG. 3 is a front enlarged exploded perspective view of a main part of FIG. 2.
Figure 4:
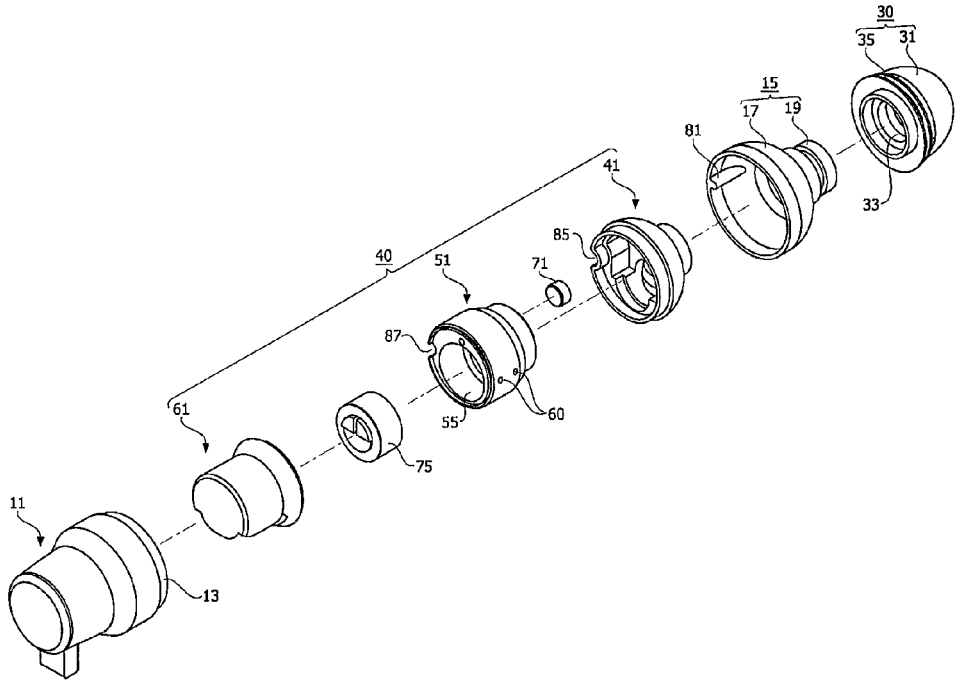
FIG. 4 is a rear exploded perspective view of FIG. 1.
Figure 5:
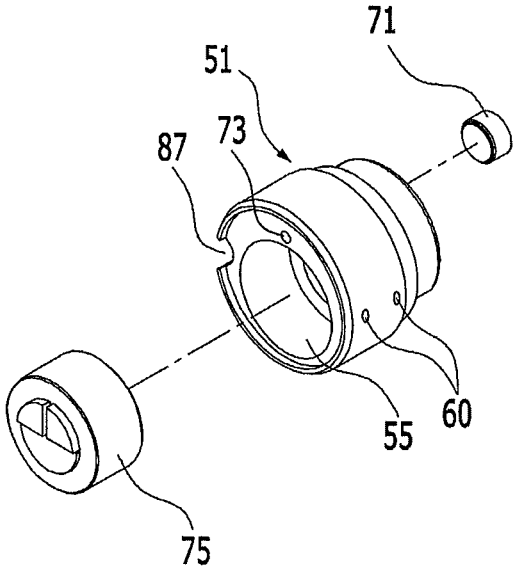
FIG. 5 is a rear enlarged exploded perspective view of a main part of FIG. 4.
Figure 6:
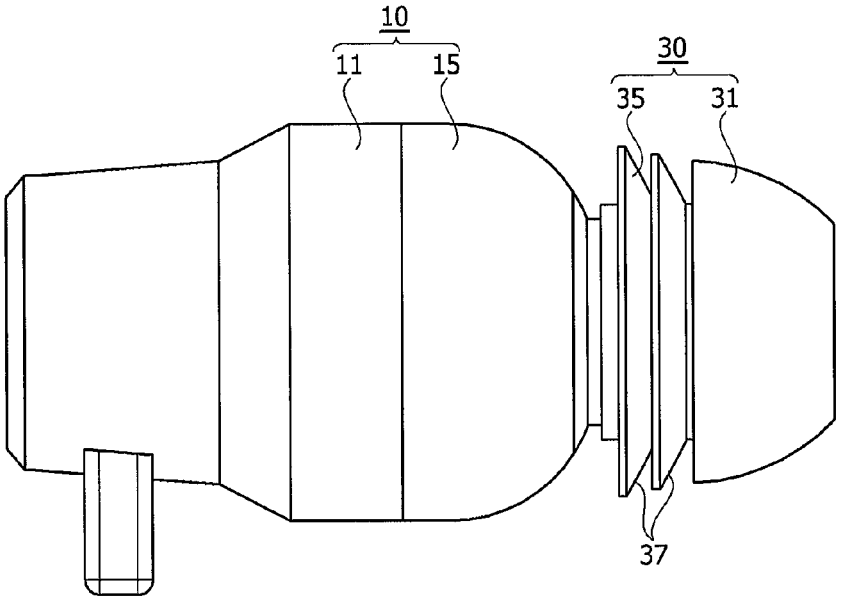
FIG. 6 is a front view of FIG. 1.
Figure 7:
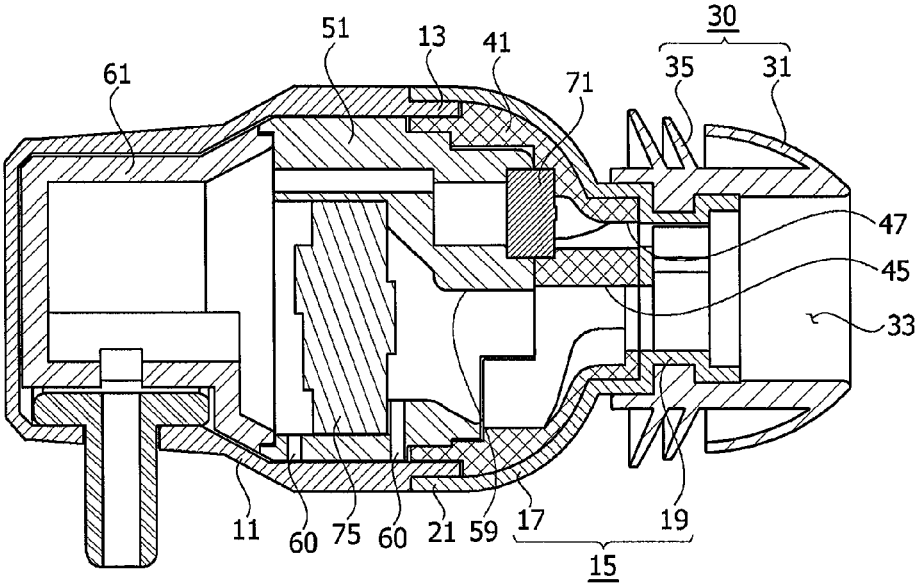
FIG. 7 is a longitudinal cross-sectional view of FIG. 1.
Figure 8:
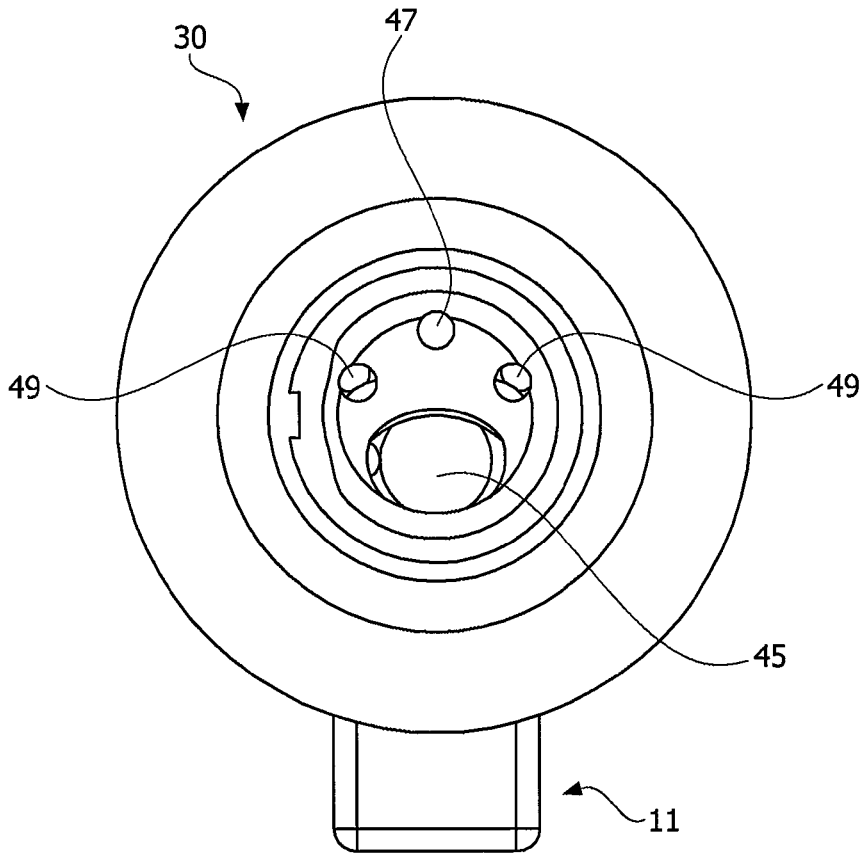
FIG. 8 is a right side view of FIG. 1.

The second soundproof housing 51 has a cylindrical shape as shown in FIGS. 3 and 5, and is provided over one region of the inner receiving space of each of the front case 15 and the rear case 11. One end of the second soundproof housing 51 is coupled to the first soundproof housing 41, and the other end thereof is coupled to the third soundproof housing 61.

Meanwhile, in an end portion of the second soundproof housing 51 facing the ear pad 30, for example, the first soundproof housing 41, a microphone accommodating groove 53 in which the microphone 71 is accommodated is formed to be recessed by a predetermined depth. In addition, the microphone accommodating groove 53 may be formed to be recessed by a predetermined depth in such a manner that an accommodating groove (not shown) is created in the first soundproof housing 41. The microphone accommodating groove 53 communicates with the microphone input hole 47 of the first soundproof housing 41 and the pair of back holes 49.

In the other end portion of the second soundproof housing 51 positioned on the opposite side to the ear pad 30, for example, facing the third soundproof housing 61, a speaker accommodating groove 55 in which the speaker 75 is accommodated is provided. The speaker accommodating groove 55 and the microphone accommodating groove 53 are blocked to each other by a partition wall 57. The speaker accommodating groove 55 is formed in the second soundproof housing 51 to be recessed by a predetermined depth.

In the second soundproof housing 51, a second speaker output hole 59 for transmitting the sound generated from the speaker 75 is penetratingly formed, and the second speaker output hole 59 and the microphone accommodating groove 53 are arranged to be independently separated from each other, so that the sound from the speaker 75 is prevented from flowing into the microphone 71.

The second speaker output hole 59 communicates with the speaker accommodating groove 55 and the first speaker output hole 45 of the first soundproof housing 41, and thereby the second speaker output hole 59 and the first speaker output hole 45 form a single through-hole.

Thus, the earset 1 according to the present invention has a structure in which the microphone 71 and the speaker 75 are deviated in the forward/backward direction with respect to the axial line of the ear pad 30, without being accommodated and arranged side by side in a vertical direction with respect to the axial line of the ear pad 30 in the same manner as that of the prior art. For example, the earset 1 has a structure in which the microphone 71 is arranged in front of the ear pad 30 and the speaker 75 is arranged behind the microphone 71.

Thus, in the earset 1 according to the present invention, the speaker 75 and the microphone 71 may be efficiently arranged to efficiently use the inner space, so that the sound output from the speaker 75 is prevented from overlapping with the sound flowing into the microphone 71 regardless of the size of each of the speaker 75 and the microphone 71. In addition, in the earset 1 having the same outer dimensions, the speaker 75 larger than the conventional speaker 75 may be mounted so that the output of the speaker 75 may be increased and the sound quality may be improved.

Meanwhile, in the second soundproof housing 51 of the earset 1 according to the present invention, a pair of tuning holes 60 that respectively communicates with the speaker accommodating groove 55 and the second speaker output hole 59 from the outside of the second soundproof housing 51 is formed.

The tuning hole formed in the speaker accommodating groove 55 out of the pair of tuning holes 60 is provided to be positioned behind the speaker 75 accommodated in the speaker accommodating groove 55.

Thus, the pair of tuning holes 60 may be provided on sides of the input and output of the speaker 75 while having the speaker 75 interposed therebetween, for example, in front of and behind the speaker 75.

In this manner, by forming the tuning hole 60 in the second soundproof housing 51, a flow space of the air, for example, a vibrancy space of the sound may be secured through the tuning hole 60, so that the vibrancy of a vibration plate (not shown) of the speaker 75 is further increased. Accordingly, the sound reaching from a low frequency band to a high frequency band may be clearly and accurately transmitted to the ear pad 30, thereby the sound quality output from the speaker 75 may be improved, and external noise may be prevented from flowing into the microphone 71 to also improve the noise shielding performance of the microphone 71.

Here, according to the present embodiment, a case in which the pair of tuning holes 60 is formed to respectively communicate with the speaker accommodating groove 55 and the second speaker output hole 59 from the outside of the second soundproof housing 51 has been described, but the tuning hole 60 may be formed to communicate with the speaker accommodating groove 55 or the second speaker output hole 59 from the outside of the second soundproof housing 51. Although not shown, the tuning hole 60 may be formed to communicate with the first speaker output hole 45 from the outside of the first soundproof housing 41. In addition, the tuning hole 60 may be formed in the third soundproof housing 61 so that the outside and the inside of the third soundproof housing 61 communicate with each other.

The third soundproof housing 61 is coupled to an end portion of the second soundproof housing 51 to block the rear side of the second soundproof housing 51, and is received in the inner receiving space formed by the rear case 11.

Meanwhile, it is preferable that the soundproof housing 40 be made of a sound-absorbing material, plastics, rubbers, a silicone, or the like, so that the ease of the assembly may be improved, noise from the outside may be blocked, and sound signals transmitted and received to and from the inside may be efficiently transmitted to the user's external auditory meatus.

Here, a non-described reference numeral 73 indicates a cable hole through which a cable for microphone (not shown) passes. The cable hole 73 is penetratingly formed to communicate with the microphone accommodating groove 53 of the second soundproof housing 51, so that the cable for microphone connected to the microphone 70 accommodated in the microphone accommodating groove 53 passes through the cable hole 73.

In addition, a non-described reference numeral 81 indicates a first alignment key that protrudes from the inner peripheral surface of the front case 15, and a reference numeral 83 indicates a second alignment key that protrudes from the inner peripheral surface of the rear case 11. A reference numeral 85 indicates a first fitting groove that is recessed on the outer peripheral surface of the first soundproof housing 41 and to which the first alignment key 81 is forcibly fitted, and a reference numeral 87 indicates a second fitting groove that is recessed on the outer peripheral surface of the second soundproof housing 51 and to which the first alignment key 81 and the second alignment key 83 are forcibly fitted. In addition, a reference numeral 89 indicates a third fitting groove that is recessed on the outer peripheral surface of the third soundproof housing 61 and to which the second alignment key 83 is forcibly fitted.

The alignment keys 81 and 83 and the fitting grooves 85, 87, and 89 may be provided, and therefore the soundproof housing 40 and the case 10 may be easily assembled while visually determining the coupling between the soundproof housing 40 and the case 10.

By the above-described configuration, in the earset 1 according to the present invention, the microphone 71 is accommodated in the microphone accommodating groove 53 of the second soundproof housing 51 or the microphone accommodating groove (not shown) of the first soundproof housing 41, the speaker 75 is accommodated in the speaker accommodating groove 55 spaced apart from the microphone accommodating groove 53, and the first soundproof housing 41, the second soundproof housing 51, and the third soundproof housing 61 are received in the inner receiving space of the case 10 in such a manner that they are combined with one another.

In addition, the earset 1 according to the present invention has a structure in which the ear pad 30 is coupled to the protrusion portion 19 of the front case 15.

As described above, according to the present invention, the microphone may be provided to face the ear pad and the speaker may be provided on the opposite side to the ear pad, and the speaker output hole and the microphone input hole may be arranged to be independently separated from each other to improve the accommodating structure of the speaker and the microphone, thereby the speaker and the microphone may be efficiently arranged regardless of the sizes of the speaker and the microphone to efficiently use the inner space, and the output of the speaker may be increased and the sound quality may be improved while avoiding the overlapping between the sound output from the speaker and the sound flowing into the microphone.

In addition, one or more tuning holes that communicate with at least any one of the speaker accommodating groove and the speaker output hole may be formed in the soundproof housing, and therefore the sound quality of the sound output from the speaker may be improved and the noise shielding performance of the microphone may be improved.

Meanwhile, in the above-described embodiment, the case in which the microphone is provided in an end portion of the second soundproof housing facing the ear pad, and the speaker is provided in the other end portion of the second soundproof housing positioned on the opposite side to the ear pad has been described, but the present invention is not limited thereto. For example, the arrangement of the speaker and the microphone may be changed so that the microphone may be provided on the other end portion of the second soundproof housing positioned on the opposite side to the ear pad, and the speaker may be provided in an end portion of the second soundproof housing. That is, in the earset in which the speaker and the microphone are integrally formed, the positions of the speaker and the microphone may be freely changed in such a manner that the speaker and the microphone may be arranged to be deviated in the forward/backward direction in the axial direction of the ear pad, without being arranged in parallel with each other.

As described above, according to the present invention, by improving the accommodating structure of the speaker and the microphone according to the increase in the output of the speaker, the speaker and the microphone may be efficiently arranged regardless of the sizes of the speaker and the microphone so that an internal space may be efficiently used, and the output of the speaker may be increased while avoiding the overlapping between the sound output from the speaker and the sound flowing into the microphone.

In addition, one or more tuning holes that communicate with at least any one of the input and the output of the speaker may be formed, thereby improving the sound quality of the sound output from the speaker and improving the noise shielding performance of the microphone.

It will be apparent to those skilled in the art that various modifications can be made to the above-described exemplary embodiments of the present invention without departing from the spirit or scope of the invention. Thus, it is intended that the present invention covers all such modifications provided they come within the scope of the appended claims and their equivalents.

What is claimed is:

1. An earset comprising:

a case that forms an appearance thereof;

an ear pad that is mounted in one end portion of the case, forms a communication hole communicating with a user's external auditory meatus, and is attached to/detached from a user's ear; and a soundproof housing that is accommodated in the case, and in which a speaker and a microphone are arranged in a forward/backward direction along an axial line of the ear pad, wherein, in the soundproof housing, one or more back holes that allow sound transmitted from the user's ears to the communication hole of the ear pad to flow into a rear surface of the microphone are formed.

2. An earset comprising:

a case that forms an appearance thereof;

an ear pad that is mounted in one end portion of the case, forms a communication hole communicating with a user's external auditory meatus, and is attached to/detached from a user's ear; and a soundproof housing that is accommodated in the case and forms a speaker accommodating groove for accommodating a speaker and a microphone accommodating groove for accommodating a microphone, wherein the microphone accommodating groove is formed toward the ear pad, and the speaker accommodating groove is formed behind the microphone accommodating groove, wherein, in the soundproof housing, one or more back holes that allow sound transmitted from the user's ears to the communication hole of the ear pad to flow into a rear surface of the microphone are formed.

3. The earset of claim 2, wherein the soundproof housing includes a speaker output hole that communicates with the speaker accommodating groove and the communication hole, and transmits sound generated from the speaker to the communication hole of the ear pad, and a microphone input hole that communicates with the microphone accommodating groove and the communication hole, and transmits, to the microphone, sound transmitted from the user's ear to the communication hole of the ear pad.

4. The earset of claim 3, wherein the speaker output hole and the microphone input hole are arranged to be independently separated from each other.

5. The earset of claim 3, wherein, in the soundproof housing, one or more tuning holes that communicate with at least any one of the input and the output of the speaker from the outside of the soundproof housing are formed.

* * * * *